United States Patent [19]

Lawes

[11] 3,937,395

[45] Feb. 10, 1976

[54] VENTED BAGS

[75] Inventor: Norman Edward Lawes, Hutton Rudby, England

[73] Assignee: British Visqueen Limited, London, England

[22] Filed: July 22, 1974

[21] Appl. No.: 490,492

[30] Foreign Application Priority Data

July 30, 1973 United Kingdom ..... 36136/73

[52] U.S. Cl. ..... 229/62.5; 224/DIG. 14

[51] Int. Cl.[2] ..... D65D 31/14

[58] Field of Search ..... 229/67.5, DIG. 14; 150/9; 206/808

[56] References Cited

UNITED STATES PATENTS

| | | | |
|---|---|---|---|
| 2,778,171 | 1/1957 | Taunton | 206/808 X |
| 2,778,173 | 1/1957 | Taunton | 206/808 X |
| 2,997,224 | 8/1961 | Stannard | 229/62.5 X |
| 3,237,844 | 3/1966 | Hughes | 229/62.5 X |
| 3,370,780 | 2/1968 | Shaw | 229/62.5 |
| 3,394,871 | 7/1968 | Williams et al. | 229/62.5 |
| 3,833,166 | 9/1974 | Murray | 229/62.5 |

*Primary Examiner*—William Price
*Assistant Examiner*—Stephen P. Garbe
*Attorney, Agent, or Firm*—Cushman, Darby & Cushman

[57] ABSTRACT

In a plastics bag having a vent comprising overlapping panels forming a part of the bag wall, with off-set apertures providing air passages from the bag interior to the space between the panels and thence to the atmosphere, at least one of the panels has an uneven surface facing the venting space in the vicinity of the internal venting apertures.

6 Claims, 2 Drawing Figures

VENTED BAGS

Figure 1:
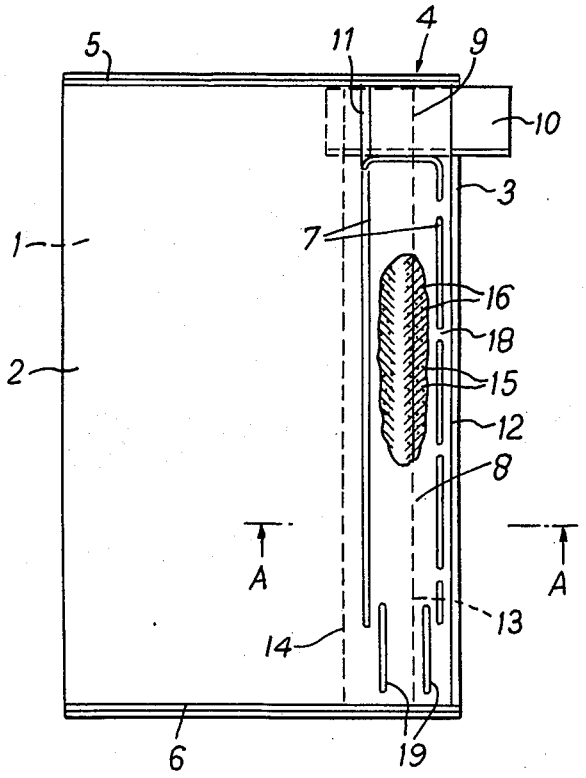

This invention relates to a vented plastics-film bag.

In a known type of vented plastics-film bag the vent comprises an area in a pair of overlapping panels forming a part of a wall of the bag, in which area are provided internal venting means in the form of at least one aperture providing communication from inside the bag to the air-space between the overlapping panels, and external venting means in the form of at least one aperture providing communication from said air-space to the atmosphere, the apertures of the internal and external venting means being laterally displaced relative to one another to provide an indirect path for air vented from inside the bag.

In one such type of bag the vent is provided in a broad margin of overlap between two panels that each form part of the general construction of the bag, as, for example, when the vent is provided in an overlap between two panels joined together longitudinally down the face of one wall of the bag, or between two flaps of a block-bottom bag. Alternatively, one of the panels forming the vent may be a patch attached internally or externally to a wall of the bag specifically for the purpose of providing a vent.

The vent apertures may be perforations in the panels, or interruptions in the seams joining the panels together and defining the area of the vent, or a combination of both.

The purpose of providing a vent in the bag is to allow any excess air introduced during filling, or remaining in the bag after filling and closure, to escape from the bag, so that filling is not interrupted, or so that the filled bags can be more easily handled and especially so that they can be properly stacked one upon another. We have found, however, especially in the packaging of powders or fine granules in such bags, that the vent apertures tend to become sealed by the two panels being pressed together and becoming blocked together, by pressure of the bag contents or by the pressure of air introduced into the bags, thus preventing the air from escaping. The problem is encountered particularly in the air-assisted filling of such materials into the bags, particularly into valved bags, since the vent is needed to allow the escape from the bag of the air that carries the powder or fine granules into the bag.

It is an object of the present invention to provide a means of overcoming this problem.

In accordance with the present invention, we provide a plastics-film bag having a vent comprising overlapping panels forming a part of the bag wall, with internal venting means comprising at least one aperture providing communication from inside the bag to the air-space between the overlapping panels and external venting means comprising at least one aperture providing communication from said air-space to the atmosphere, the apertures of the internal and external venting means being laterally displaced relative to one another to provide an indirect path for air vented from inside the bag, in which at least one of the overlapping panels has on its side facing said air-space an uneven surface at least in an area adjacent to the internal venting means.

We have found that, because air can pass out of the internal venting apertures into the air-space through the presence of projections from or indentations in one of the opposed surfaces in the vicinity of the apertures, blocking of the vent panels is prevented and air is able then to pass freely out of the bag on compression of the bag, or on the introduction of excess air into the bag.

In one preferred form of the bag of the invention, the vent is provided between two longitudinally-overlapping panels forming one wall of the bag, in an area defined by spaced-apart longitudinal seals joining the two panels; these seals may conveniently function also as constructional seals for the fabrication of the sack from a folded web. Such a bag may have an open mouth, or may be formed as a valved bag, closed around its periphery and having the longitudinal seals of the vent interrupted to leave a substantially transverse passageway between the overlapping panels into the bag, to provide a filling valve.

Figure 2:
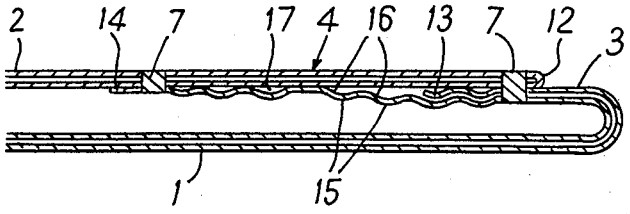

One such preferred design of the bag of the invention will now be described by way of example with reference to the accompanying drawings, of which:

FIG. 1 is a front view of a 2-ply plastics-film, vented, valved, heavy-duty sack constructed in accordance with the invention, shown with a part of the outer panel of the vent removed; and FIG. 2 is a section through A — A of FIG. 1.

In these Figures: 1 represents the back wall of the sack; 2 and 3 are overlapping panels forming the front wall and having a broad margin of overlap indicated generally at 4; and 5 and 6 are heat-seals closing the top and bottom of the sack respectively. 7 is a heat-seal of inverted U-shape, joining the two front panels 2 and 3, defining the area, 8, of the vent, and also forming, with the heat-seal 5, a filling valve, 9, through the overlap of panels 2 and 3; this filling valve is provided with a tuck-in sleeve, 10, held in place by a heat-seal, 11, between the front face of the sleeve and panel 2, and, if desired, by a similar heat-seal between its back face and panel 3. 12 is a fold joining the two plies of panel 2, and 13, 14 are the edges of the outer and inner plies of panel 3, respectively. It will be seen that a web suitable for the continuous production of the bag units may be formed from tubular film by folding, one edge being slit along a line spaced from the original fold-line of the lay-flat tubular film, and this edge-fold being opened out. The extended layer of panel 3, which provides the inner panel of the area 8, is crimped over this area, as shown at 15, to provide an arrangement of parallel ribs in two series forming a chevron. The crimping is restricted to the vent area of the sack, the film in the valve area being left smooth. The same layer of panel 3 in the area 8 is also provided with numerous pinholes, 16, arranged in staggered rows; these constitute the internal venting means, from the interior of the sack to the space 17 (FIG. 2). Spaces, 18, in the outer arm of the seal 7 provide the external venting means, from the space 17 to the atmosphere. Further venting means are provided at the bottom of the sack, where both arms of heat-seal 7 stop short of the bottom heat-seal, and two short seals, 19, are provided between the panels 2 and 3 as shown.

Various modifications may be made in the bag particularly described. For example, the bag may be an open-mouthed bag, with the valve omitted and the vent continuing, if desired, to the mouth of the bag. And although, in the bag described, the pin-holes form the main part of the internal venting means, spaces in the inner arm of the heat-seal 7 could be provided instead for this purpose, with the ribs on the surface of the vent panel extending to a line close to this seal. Similarly, pin-holes may be used, instead of spaces in the heat-seal, as the external venting means. Or, instead of pinholes, a smaller number of larger apertures could be provided, especially if they were to form the internal venting means. If desired, the outer panel 3 may be provided with ribs or other projections on its inner surface in the overlap area, facing the air-space 17, instead of, or as well as, projections provided on the surface of panel 2. It is necessary only that the projections be sufficiently close to the internal venting means to provide air passages into the space 17. As previously indicated, the vent may be formed in other overlapping areas of a conventional bag construction, or may be formed by means of a panel attached to the bag wall specifically for this purpose.

Instead of a surface of the vent being ribbed as described, the required unevenness may be provided in other ways, for example by embossing the film to provide projections or indentations of other shape, or by attaching particles to the surface. The provision of ribs by crimping is, however, a particularly convenient method, as it can be readily applied to a travelling web, during manufacture of the bags, by passing the edge region between crimping rollers, which may be separated at intervals to leave any portions of smooth film that may be desired, for example in providing filling valves. When the valve is provided with a sleeve, for example as shown in the accompanying drawings, the crimping or other form of unevenness may extend through the valve area.

Pinholes or apertures of other form may similarly be easily formed during manufacture of the bags by passing the web between a pair of perforating rollers.

It will be appreciated that the terms "back wall" and "front wall" have been used only for ease of description of the bag, and may be reversed.

Because polyethylene (in which term we include copolymers of ethylene with minor proportions of other monomers), especially low-density polyethylenes, and also polyvinyl chloride, are widely used in the production of sacks, and because these plastics materials often show a marked tendency for adjacent layers to block in the circumstances described, the invention is used with particular advantage in the construction of bags of such materials, especially in the production of heavy-duty sacks for fertilizers, plastics powders and fine granules, chemicals, cement and the like. For example, a bag as particularly described with reference to the drawings, 520 mm × 850 mm in size, may suitably be made from a 2-ply web of 100 micron-thick film of low-density polyethylene. However, the invention may of course be used in the construction of bags from other plastics film materials and for other uses. The use of the bags of this invention greatly facilitates the filling operation in respect both of open-mouthed and of valved sacks, especially air-assisted filling operations.

I claim:

1. In a plastics-film bag having one wall formed by two longitudinally-overlapping panels joined one to the other by two spaced-apart longitudinal seals, the bag being provided with a vent comprising an interfacial air-channel between said overlapping panels and defined by said longitudinal seals, internal venting means comprising at least one aperture providing communication from inside the bag to said interfacial air-channel, and external venting means comprising at least one aperture providing communication from said air-channel to the atmosphere, the apertures of the internal and external venting means being laterally displaced relative to one another to provide an indirect path for air vented from inside the bag, the improvement comprising providing an uneven surface on at least one of the overlapping panels on its side facing said air-channel at least in an area adjacent to the internal venting means.

2. A bag as claimed in claim 1 closed around its periphery and provided with a filling valve.

3. A bag as claimed in claim 2 in which said longitudinal seals are interrupted to leave a substantially transverse passageway between said panels into the bag to provide the filling valve.

4. A bag as claimed in claim 1 in which said uneven surface is provided by a crimped area of the panel.

5. A bag as claimed in claim 1 in which the internal venting means are pinholes through the underlying panel in the area of overlap.

6. A bag as claimed in claim 1 in which the external venting means comprise at least one interruption in that of the said longitudinal seals which is nearer the overlapping edge of the outer panel.

* * * * *